US005111635A

United States Patent [19]

Neber

[11] Patent Number: 5,111,635

[45] Date of Patent: May 12, 1992

[54] ARRANGEMENT FOR CLOSING BOTTLES

[75] Inventor: Fritz Neber, Schwäbisch Hall, Fed. Rep. of Germany

[73] Assignee: Firma Groninger & Co. GmbH, Crailsheim, Fed. Rep. of Germany

[21] Appl. No.: 518,114

[22] Filed: May 3, 1990

[30] Foreign Application Priority Data

Jan. 26, 1990 [DE] Fed. Rep. of Germany ... 9000905[U]

[51] Int. Cl.[5] ..... B67B 3/18; B67B 3/20; B65B 7/28

[52] U.S. Cl. ..... 53/334

[58] Field of Search ..... 53/334, 333, 338, 340, 53/488, 310, 306

[56] References Cited

U.S. PATENT DOCUMENTS 1,495,650 5/1924 Taliaferro ..... 53/334 X
1,495,651 5/1924 Taliaferro ..... 53/334
1,495,652 5/1924 Taliaferro ..... 53/334
1,628,007 5/1927 Taliaferro ..... 53/334
3,775,944 12/1973 Roberts ..... 53/334
3,964,234 6/1976 Hurst ..... 53/334 X

*Primary Examiner*—Horace M. Culver
*Attorney, Agent, or Firm*—Michael J. Striker

[57] ABSTRACT

An arrangement for closing bottles comprises a rotor arranged to move bottles over a partially circular path, a flanging device provided with a flanging element arranged to engage with lower edges of caps to be placed on the bottles, bottles gripping elements connected with the rotor and arranged to rotate the bottles about their own axes and also to disengage the bottle from the flanging element, the flanging element including a centrally arranged disc having a ringshaped part with a peripheral edge engageable with the cap, the disc having an axis which extends parallel and is eccentric relative to an axis of the rotor, and the disc being arranged so that the partially circular path of the bottles extends around the peripheral edge of the disc.

19 Claims, 5 Drawing Sheets

ARRANGEMENT FOR CLOSING BOTTLES

BACKGROUND OF THE INVENTION

The present invention relates to an arrangement for closing bottles, including a rotor which moves the bottles along a partially circular path, a flanging device with a flanging element engaging the lower edge of the caps to be applied on the flanges, and bottle gripping elements connected with the rotors.

Arrangement of the above mentioned general type are known in the art. One of such arrangements is disclosed for example in the British Patent Document GB-PS 1,365,978. In this arrangement the flange element provided with an arcuately extending edge is composed of a substantially sickle-shaped immovable rail or strip arranged at a radial distance from the partially circular path and outwardly of the path. The arcuate edge which operates during the flanging, is located at the inner side of the flanging rail which faces the respective outer side of the passing bottles. The stationary flanging rail is formed substantially as a circular segment. It is held by two spaced forks on the pin extending between the respective fork legs. A compensation spring is arranged between each leg of each fork and the flange rail. Both forks are mounted on a curved bridge part which in turn is height-adjustable along a vertical support and fixable in respective positions. Sleeves arranged on the bridge part serve for a horizontal adjustment. Both forks are adjustable horizontally by adjusting screws and against the force of the springs. In view of this construction, arrangement and support the flange device is rather complicated. It requires a number of individual structural elements and therefore is expensive and failure prone. The horizontal adjustment of the flange rail is performed by respective adjustment of the forks by means of the horizontal adjustment screws. This adjustment is time consuming and complicated. It is difficult to obtain the accurately designed position of the flange rail by this horizontal adjustment. Also, the vertical adjustment of the flange rail is similarly time consuming and difficult, since for this purpose the bridge part which holds both forks must be displaced along the vertical support and fixed in respective positions. During the flanging process the rotatable bottles pass the inner, curved shaped edge of the flange rail. First each bottle at one end of the flange rail runs in this region. Therefore there is a high degree of danger that the bottle will hook during this running in. Also, accurate adjustment of the flange element should be considered as extraordinarily critical. A further disadvantage is that this known arrangement must be adjusted completely anew in correspondence with the new bottle format. The format adjustment here is extraordinarily time consuming and complicated. During conversion to a different bottle height and especially cap diameter, not only a suitable new flange rail must be mounted and adjusted, but also the rotary speed of the rotor and/or the bottle gripper must be adjusted correspondingly. Each conversion to a different format requires complicated adjustment works in the known arrangement. Moreover, it is disadvantageous that the flange device is arranged at the edge. It requires some additional space, which is especially disadvantageous since in this region very narrow space conditions prevail. Moreover, this arrangement affects a reliable cleaning and especially sterilization of the machine, especially during sterilizing aeration from above with laminar flow. It is further disadvantageous that the flange rail in the known arrangement requires a great radius to insure that with a certain minimum peripheral angular extension of the flange rail during rotation of the bottles along it the flanging process is completely closed. This contradicts the goals of compact constructions having as small diameter as possible. Furthermore it contradicts the tendency to provide a quiet bottle running with low noise generation and material loading.

SUMMARY OF THE INVENTION

Accordingly, it is an object of the present invention to provide an arrangement for closing bottles of the above mentioned general type, which avoids the disadvantages of the prior art.

More particularly, it is an object of the present invention to provide an arrangement for closing bottles, which has a simple and inexpensive flange element, can be adjusted to different bottle geometries in a fast and simple manner, and can be provided with a rotor of a small pitch.

In keeping with these objects and with others which will become apparent hereinafter, one feature of the present invention resides, briefly stated, in an arrangement of the above mentioned type, in which the flange element includes a centrally arranged disc provided with a ring-shaped part with a peripheral edge engaging the caps for the necks of the bottles, the axis of the disc extends parallel and is eccentric to the rotor axis, and the partially circular path of the bottles extends around the peripheral edge of the disc.

The bottle closing arrangement in accordance with the present invention has a rotor, to which bottles to be closed are supplied from a bottle transporting element via a running-in star. The rotor transports the bottles along the flanging device and guides the closed flanges by a running-out star again to the transporting device. The flanging device is formed as a flanging disc. The transporting of the bottles around the flanging disc is performed so that the lower edge of the cap placed on the head of the bottle comes in engagement with the edge of the horizontal disc and is flanged by it. The bottles rotate about their own axes, so that each point of the edge of the cap to be flanged comes in engagement with the flanging disc many times, and thereby is gradually flanged.

The flanging of the cap is performed thereby by rolling of the lower edge of the cap on the centrally arranged disc so that the edge is bent gradually. With the utilization of a single disc as a flanging device, the inventive bottle closing arrangement has a simple and inexpensive construction. Moreover, the flanging device can be adjusted in a simple and short way since only the disc is to be adjusted. Moreover, the bottle closing arrangement can be adjusted to another cap diameter by exchange of the disc in a simple and fast manner. Since the flanging device is formed as a compact, centrally arranged disc and no space between the bottles is required, the rotor of the closing arrangement can be provided with a small pitch. Therefore with a high bottle output or small bottles, the rotary speed of the rotor is relatively low and thereby a quiet bottle running with low noise generation and material loads is achieved. With the inventive arrangement the bottles are guided by the rotor around the disc so that the lower edge of the cap applied on the bottle head gradually approaches the disc and comes in engagement with its edge and then is gradually flanged. By the rotary movement of the bottle, this movement is performed almost uniformly over the whole periphery of the cap.

In accordance with an advantageous and simple embodiment of the invention, the radius of the partially circular path of the bottles is equal to the sum of the radii of the disc and the cap placed on the head of the bottles.

The engagement depth of the disc under the bead provided on the head of the bottle, under which the lower edge of the cap is flanged, is advantageously adjusted so that the disc is radially displaceably fixed relative to the rotor. The eccentricity of the axis of the disc relative to the axis of the rotor can be adjusted so that the cap of the bottle comes into engagement with the disc more or less strong.

In accordance with an advantageous embodiment of the invention, the disc has a thickness which reduces toward its edge, and the edge of the disc is formed as a dull cutting edge. This specific construction of the disc provides for a gradual bending of the lower edge of the closed cap, so that the material of the cap is loaded uniformly, but not excessively. Advantageously, the disc is composed of metal and has a hardened edge region.

Preferably the disc is supported on the rotor fixedly for joint rotation with it or in other words it is supported non-rotatably relative to the rotor. Therefore during the flanging, the lower edge of the closure cap rolls on the disc. In accordance with another embodiment of the invention, the disc can be supported on the rotor rotatably, so that it rolls on the closure cap in correspondence with the rotary speed of the bottles.

A fast and simple conversion of the bottle closing arrangement to bottles with different cap diameters is performed when in accordance with the advantageous embodiment the disc is exchangeably fixed in the arrangement. This fixation is also advantageous for a simple and fast disc exchange for repair, inspections or overhauling purposes.

In accordance with a further advantageous embodiment of the invention, the bottle gripper has a cap centering element engaging with the head of the bottle and a lifting device which engages the bottle and is controlled by a curve or cam. The bottle gripper which is driven by the rotor takes the bottles coming from the running-in star so that the bottle is placed on the lifting plate of the lifting device and finally is held by the cap centering element at the head. The cap placed earlier at the bottle is centered by the cap centering element and held down. The curve-controlled displacement device has two positions, namely a running-in or a running-out position and a working position. The lifting plate of the lifting device in the running-in or running-out position is located in a lower position, so that a bottle can be placed at a distance to the cap centering element on the lifting plate. Directly after this, the lifting plate moves along a curve control to an upper position, namely its working position. During this lifting movement the head of the bottle with the placed cap moves under the cap centering element and is held by it. During the flanging process the head of the bottle is supported on the cap centering element.

Advantageously the cap centering element has a centering head which is rotatable and supported by a spring. The centering head presses the cap placed on the bottle head in direction to the bottle opening so that it cannot deviate during the flanging process. The rotary movement of the bottle is supported by the rotatable arrangement of the centering head in the cap centering element. The height tolerance of the annular bead on the bottle mouth is compensated in that the centering head is supported in the cap centering element by a spring and thereby is heightadjustable in a certain region.

Bottles with different heights can be placed into the inventive bottle closing device, since the cap centering element is fixed in a height-adjustable manner on the rotor. By a simple adjustment of the cap centering element to the height of the bottles to be closed with simultaneous height adjustment of the flanging disc, the arrangement can be adapted to bottles with different formats.

A further simplification of the adjustment of the bottle closing arrangement is obtained in that the cap centering element and the disc together with a rotor form a movable flanging head. Therefore, the bottle closing arrangement can be converted reliably and fast to a different format, especially to a different cap diameter. For this purpose, after loosening for example a screw grip, the complete flanging head composed of a cap centering element and a disc with their eccentric support, is removed from the rotor and replaced by a flanging head adjusted to a different cap format on another bottle. This new flanging head has a pre-adjusted flanging disc and adjusted cap centering element. By the exchange of a single structural part the closing device can be converted in shortest possible time. The exchange can be performed by unskilled personnel in less than one minute since no adjustment works are required.

Advantageously, the height of the flanging head is adjustable by a handle wheel. By the handle wheel the disc can be exactly adjusted to the bottle bead, under which the lower edge of the closure cap must be flanged.

A rotation of the bottles about their own axes is performed in that the lifting device is connected in its working position with a wedge belt drive or a toothed wheel drive. By this drive the lifting plate of the lifting device is rotated and thereby the bottle placed on the lifting plate is also rotated. This driving is performed when the lifting device is located in its working position. When however it is located in its running-in or running-out position in which they take a bottle from the running-in star or discharges a bottle to the running-out star, it is released from the drive.

It is advantageous when the rotary speed of the drive is adjustable steplessly. The rotary speed can be adjusted in dependence upon for example the periphery of the closure cap, the material of the closure cap and the rotary speed of the rotor or to an optimal value for the flanging.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
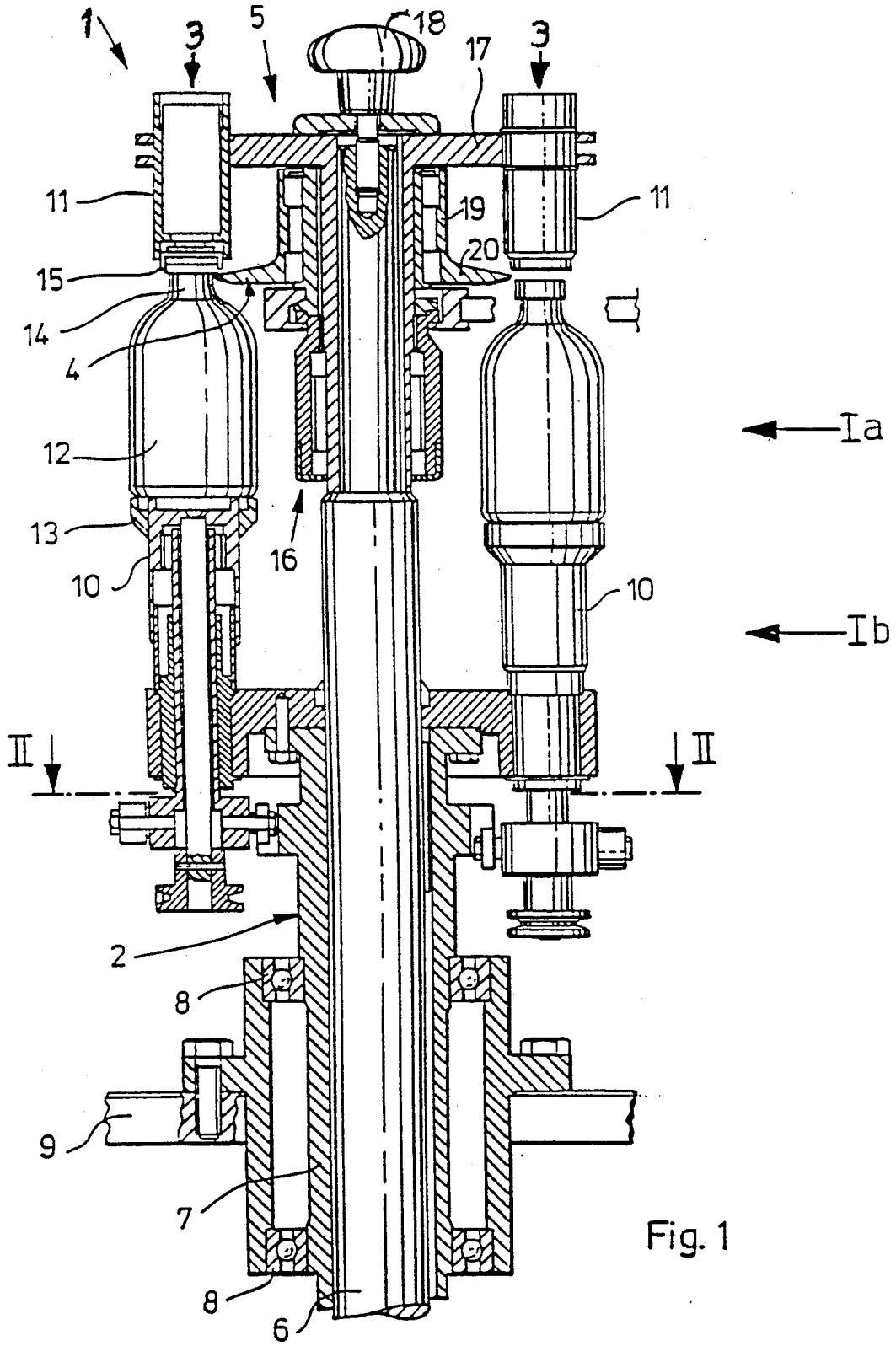
FIG. 1 is a side view of a bottle closing device in accordance with the present invention, partially in section.
Figure 1A:
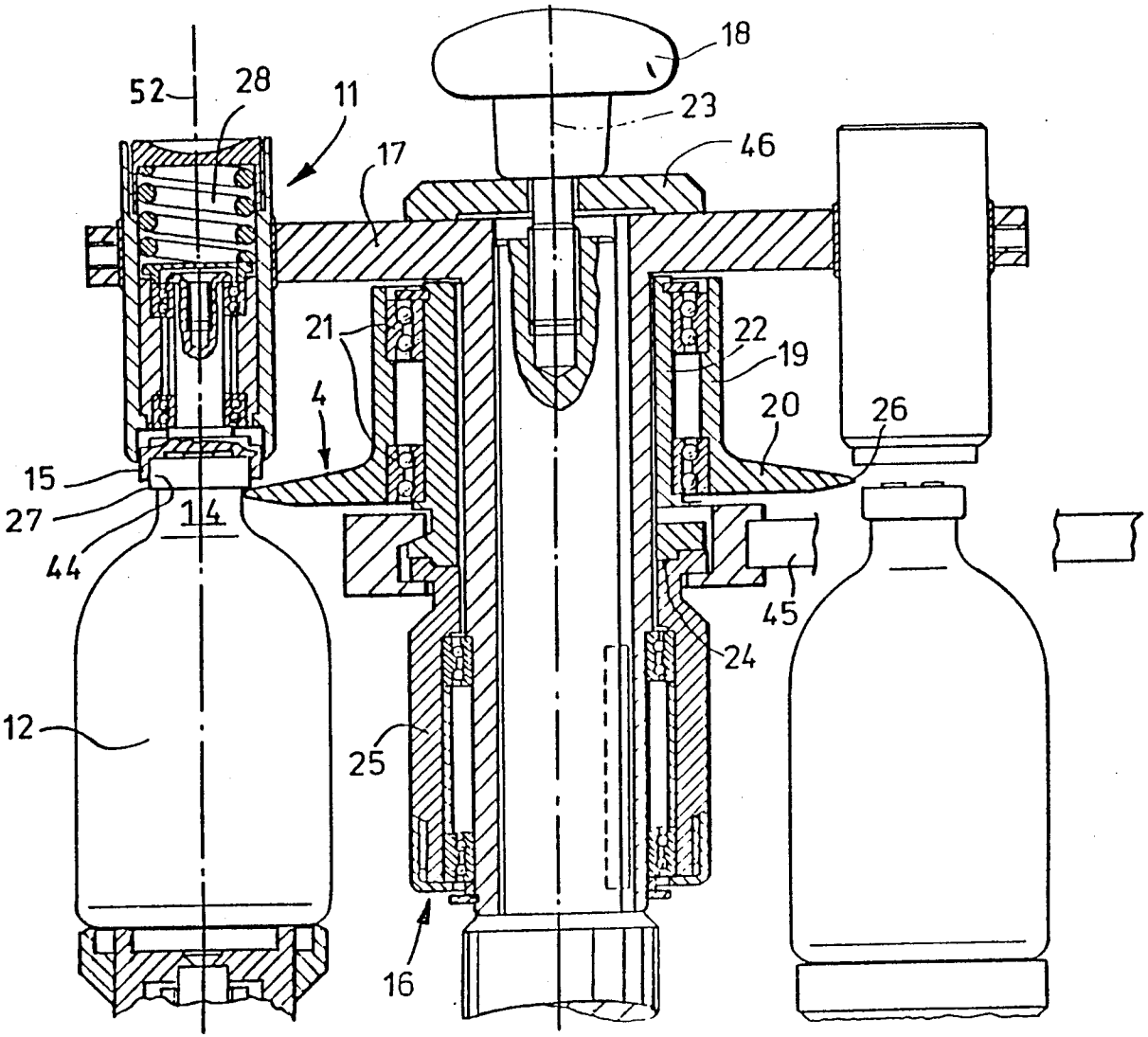
FIG. 1*a* is a view showing a fragment Ia of the bottle closing device of FIG. 1.

FIG. 1 shows a bottle closing arrangement which is identified as a whole with reference numeral 1. The arrangement has a rotor 2. Several bottle grippers 3 which are uniformly distributed over the periphery and connected with the rotor 2, and a central flanging device 5 provided with a flanging disc 4. The rotor has a rotor shaft 6 which is driven by a not shown motor. The rotor shaft 6 has in turn a rotor housing 7 connected with the rotor shaft for joint rotation therewith. The rotor housing 7 is supported on a foundation 9 through a ball bearing 8. Bottle grippers 3 are fittedly connected with the rotor housing 7 for joint rotation with it. The bottle gripper 3 include a lifting device 10 and a cap centering element 11. A bottle 12 is located between the cap centering element 11 and the lifting device 10 and lies on a lifting plate 13. The bottle 12 is held at its head 14 by a centering head 15 of the cap centering element 11.

The rotor shaft 6 is provided at its upper end with a flanging head 16. The flanging head 16 is composed substantially of a cap centering holder 17 with the cap centering element 11 mounted on it, and the flanging disc 4. The flanging head 16 is mounted on the upper end of the rotor shaft 6 by a handle wheel 18.

As can be seen in FIG. lb, the flanging disc 4 includes a ring-shaped part 20 formed of one piece with a sleeve 19. The sleeve 19 in turn is connected with an eccentric sleeve 22 through a ball bearing 21. The eccentric sleeve 22 is inserted in a supporting sleeve 25 which is rotatable on the cap centering holder 17. More particularly it is inserted in an opening 24 provided in the supporting sleeve 25 and eccentric relative to the rotor axis 23.

The ring-shaped part 20 of the flanging disc 4 reduces radially outwardly. In other words, the thickness of the ring-shaped part 20 reduces radially outwardly. Its edge 26 is formed as a blunt cutting edge. The lower side of the ring-shaped part 20 is angled in its radially outer region in direction toward the upper side.

As can be seen from FIG. la showing a fragment of FIG. 1, the centering head 15 of the cap centering element 11 abuts against a cap 27 which are arranged on the head 14 of the bottle 12 and holds the cap down in direction toward the bottle 12. The centering head 15 is therefore supported indirectly on a spring 28. The spring 28 provides for compensation of tolerance difference in the height of the ring bead on the bottle head 14.

Figure 1B:
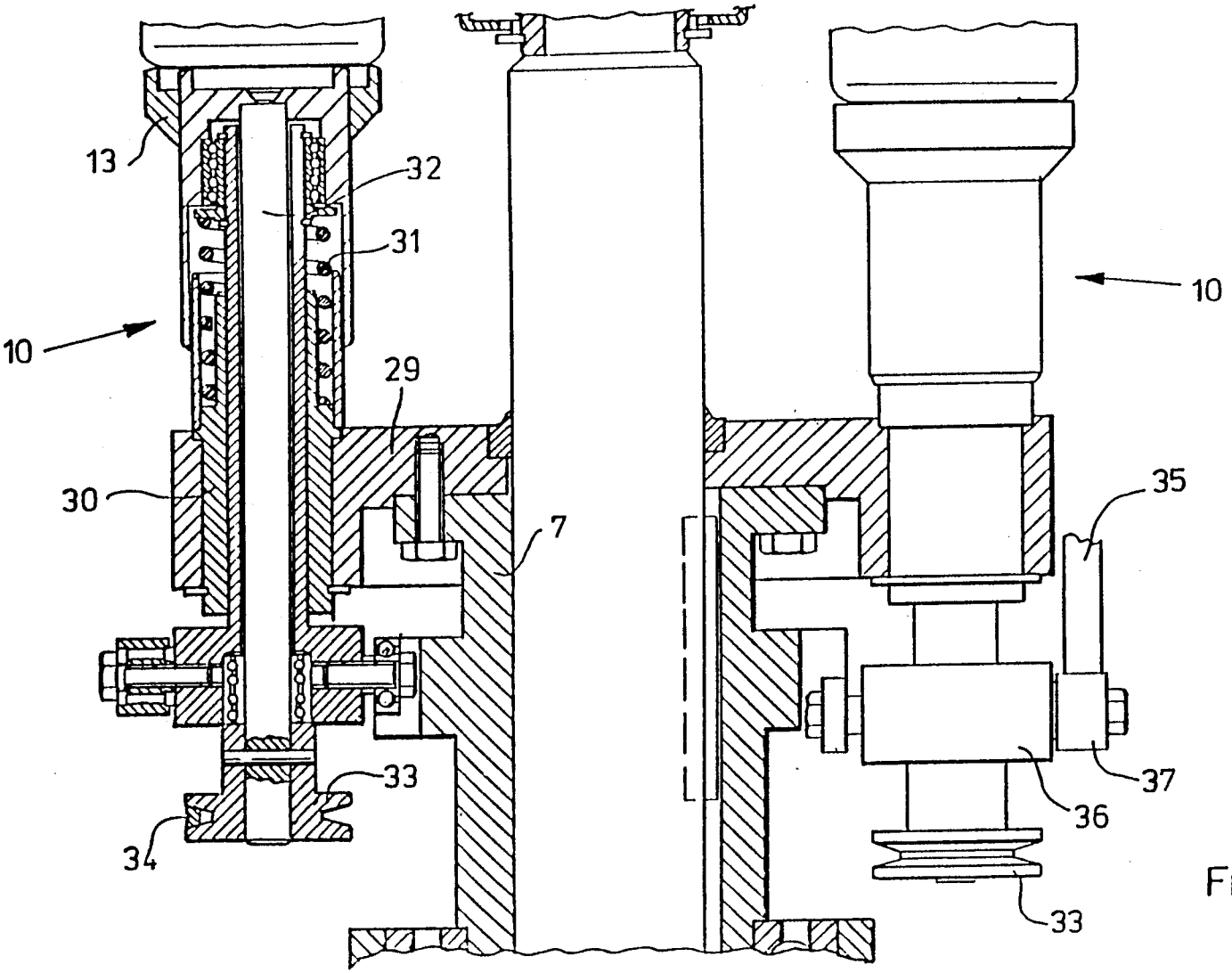
FIG. 1*b* is a view showing a fragment Ib of the bottle closing device of FIG. 1.

FIG. 1*b* shows a section of FIG. 1 through the lifting device 10 on an enlarged scale. The lifting device 10 includes substantially a holder 29 connected with the rotor housing 10 and a plurality of housings 30 which are fixed to the holder and uniformly distributed over its periphery. A plunger 32 with a lifting plate mounted on its upper end is axially movably guided in the housing 30 against the force of the spring 31. The lower end of the plunger 32 has a belt pulley 33 which cooperates with a wedge belt 34 in the working position of the lifting device 10. The wedge belt 34 transfers a rotary movement to the plunger 32 and thereby to the lifting plate 13 through the belt pulley 33.

The working position is illustrated in the left side of FIG. 1*b*. From this position the lifting device 10 is transferred to a running-in position or a running-out position by a control curve or cam 35. The control curve 35 deviates the plunger 32 downwardly through a radially projecting pin which is provided with a wheel 37 and follows the control curve. In this position at the right side of FIG. 1*b* the belt pulley 33 of the plunger 32 is out of engagement with the wedge belt 34. The lifting device 10 rotates only when it is located in its working position.

Figure 2:
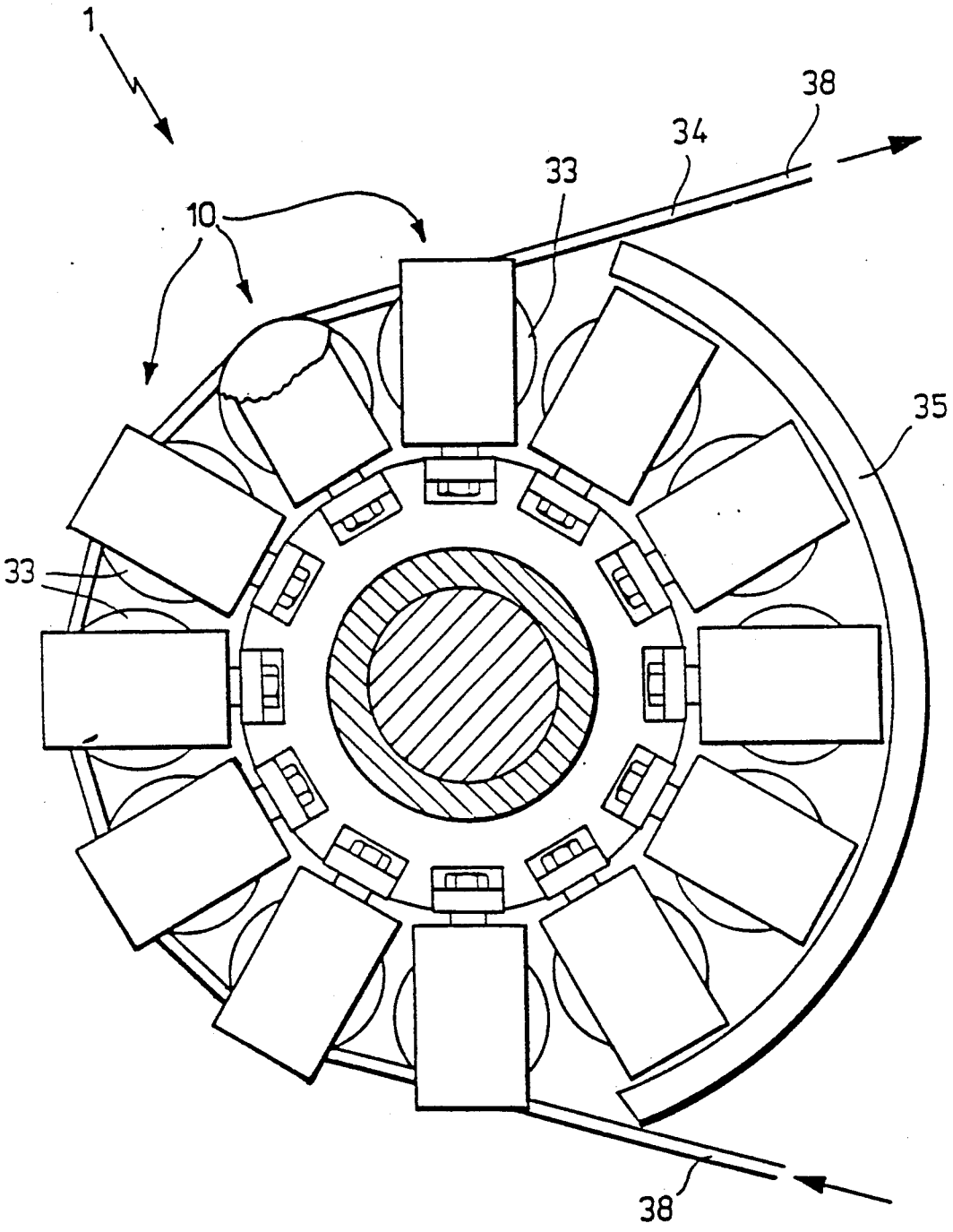
FIG. 2 is a view showing a section along the line II—II in FIG. 1.

FIG. 2 on a section taken along the line II—II through the bottle closing arrangement 1 shows substantially the lower ends of twelve lifting devices 10 which are uniformly distributed over the periphery. Seven lifting devices are located in a working position and five lifting devices are located in a running-in or running-out position. The seven lifting devices located in the working position are connected with one another by the wedge belt 34. This wedge belt engages with the belt pulley 34 of each lifting device 10. The lifting devices located in the running-in or running-out position 10 are not in engagement with the wedge belt 34 and are displaced axially in the plane of the drawing by the control curve 35 engaging with a not shown wheel 37 of the pin 36. The ends 38 of the wedge belts 34 are connected with one another by a not shown drive with a steplessly adjustable rotary speed.

Figure 3:
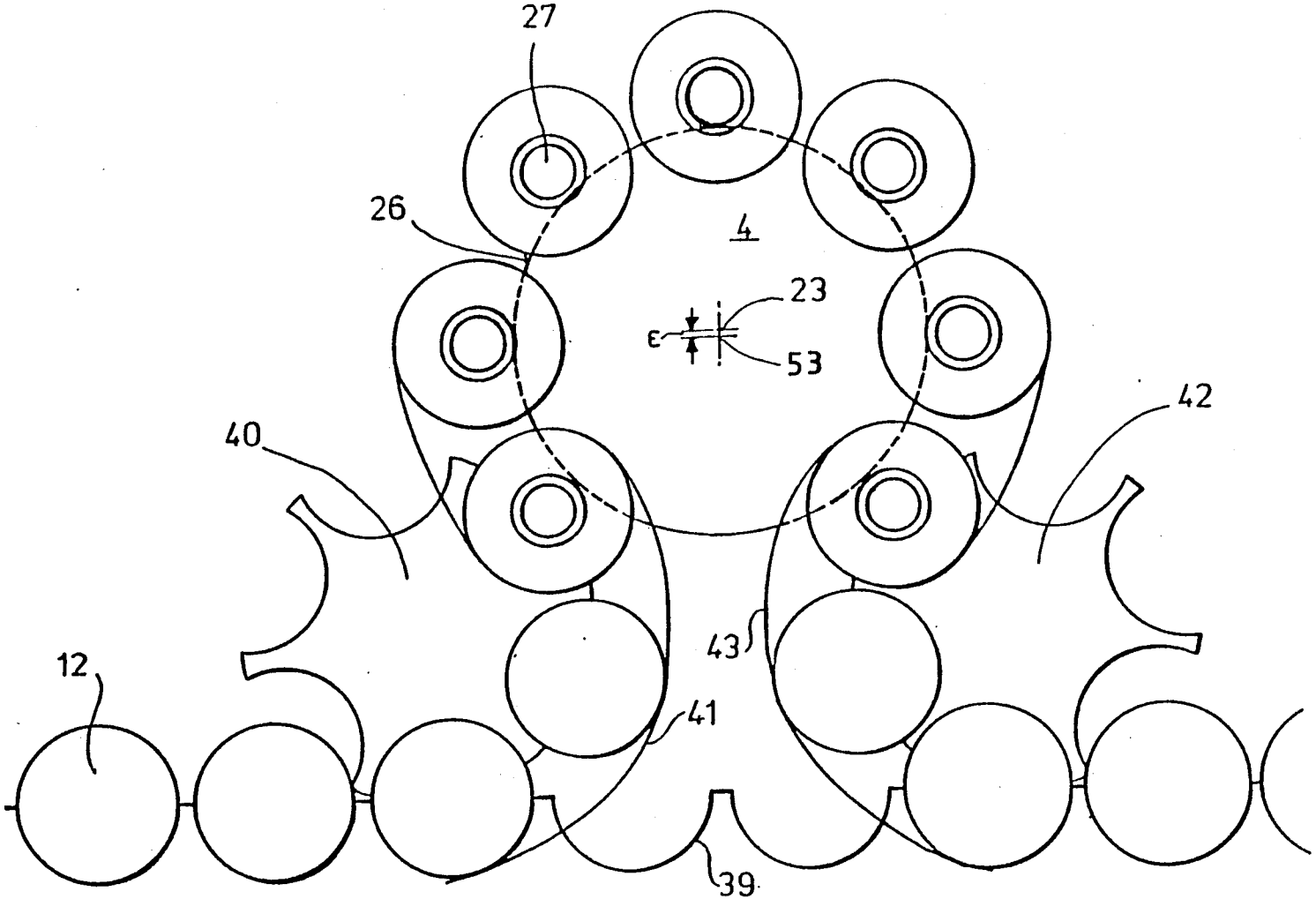
FIG. 3 is a view schematically showing a bottle passage through the inventive bottle closing device.

The bottle movement which is shown schematically in FIG. 3 includes transportation by a bottle transporting element 39. The bottles 12 are inserted from the bottle transporting element 39 into the bottle closing arrangement 1. A running-out star 42 with a guiding curve 43 withdraws the bottles 12 from the bottle closing arrangement 1 and delivers them further to the bottle transporting element 39.

The closing process for a bottle closing is described hereinbelow. A not shown supply device places a cap 27 over the bottle 12 which is coming the bottle transporting element 39 of FIG. 3. The bottle 12 is then supplied, as described hereinabove, to the bottle gripper 3 of the bottle closing arrangement 1 by the running-in star 40. The lifting device 10 of the bottle gripper 3 is located in a running-in position, so that the bottle 12 can be placed between the cap centering element 11 and the lifting device 10 on its lifting plate 12. In this running-in position the lifting device 10 is pressed downwardly by the control curve 35 which engages the wheel 37 of the pin 36 so that the pin 36 connected with the plunger 32 guides the plunger 32 and therefore the lifting plate 13 in correspondence with the contour of the control curve 35.

When the bottle 12 is inserted between the lifting plate 13 and the cap centering element 11, the lifting device 10 moves along the control curve 35 to its working position and clamps the bottle 12 between the lifting plate 13 and the centering head 15. In addition to a stable position of the bottle 12, the cap 27 is also pressed onto the head 14 of the bottle 12. As long as the lifting device 10 reaches the working position, the bottle 12 is freely held in the bottle gripper 3 by the force of the spring 28 of the cap centering element 11 and the spring 31 of the lifting device 10.

Due to the rotary movement of the rotor 2, the belt pulley 33 of the plunger 32 of the lifting device 10 engages with the wedge belt 34 immediately after the lifting device 10 which is its working position and drives it in rotation. This rotation of the lifting device 10 causes a rotation of the bottle 12 about its own axis 52. The rotor 2 moves the bottle 12 along a circular path around the axis 23 of the rotor 2. The radius of this circular path corresponds to the distance of the axis 52 of the bottle 12 from the rotor axis 23. On its circular path the lower edge of the cap 22 gradually comes in contact with the edge 26 of the flanging disc 4. This is obtained in that the flanging disc 4 is arranged with the eccentricity $\epsilon$ eccentrically to the axis 23 of the rotor 2. This eccentric arrangement of the axis 53 is shown in FIG. 3. It can be clearly seen how the cap 27 comes in engagement gradually with the edge 26 during its rotation around the flanging disc 4.

Due to gradual running-on of the lower edge of the cap 27 and the edge 26 of the flanging disc 4 as a result of the eccentricity $\epsilon$ of both axes 23 and 53, a continuous bending of the edge under the bead 44 on the head 14 of the bottle 12 is performed. During the rotation of the bottle 12 each point of the lower edge of the cap 27 comes in engagement with the flanging disc 4 many times so that the edge is flanged uniformly over its whole periphery. During this flanging process, the disc 4 is either held in a rotary fixed manner or connected in a rotatably movable manner with the rotor 2. In the latter case the flanging disc 4 is rotated by the friction with the cap 27 and by its rotary movement.

After the flanging step, the belt pulley 33 of the lifting device 10 disengages from the wedge belt 34 and is brought by the control curve 35 from its working position to its running-out position in accordance with FIG. 2. The lifting plate 13 lowers and the head 14 with the flanging cap 27 is pulled out from the centering head 15 of the cap centering element 11 as shown at the right end in FIG. la. It can be seen from this Figure how the head 14 of the bottle 12 moves from the edge 26 of the flanging disc 4 due to the eccentricity $\epsilon$ of the rotor axis 23 and the disc axis 53. The bottle 12 is withdrawn via the running-out star 42 from the bottle gripper 3 and again supplied to the bottle transporting element 39 in correspondence with the diagram shown in FIG. 3.

The value with which the edge 26 of the flanging disc 4 engages the bead 44 of the head 14 is preferably adjusted by a device 45. The eccentric sleeve 22 is turned by the device 45 in the eccentric opening 24 of the supporting sleeve 25 so that the distance from the disc axis 53 to the rotor axis 23 and thereby the eccentricity $\epsilon$ is changed. The device 45 can perform for example fine adjustments of the flanging disc 4 or can adjust the flanging disc 4 to the bottles 12 with different beads 44.

When it is necessary to adjust the bottle closing device 1 to the bottles 12 with different bottle formats, the handle wheel 18 is released, the clamping disc 46 is removed and the flanging head 16 is withdrawn from the upper end of the rotor 2. Then a new flanging head 14 with the cap centering element 11 corresponding to the format of the new bottle and with a correspondingly adjusted flanging disc 4 is mounted on the free end of the rotor 2.

A conversion to another cap diameter is performed by exchange of a single part, namely the flanging head 16 of the bottle closing arrangement 1. In addition to the advantage of the fast format exchange and the simple and fast adjusting, the bottle closing arrangement in accordance with the present invention has the advantage in that only a single flanging head 16 is required for each format of bottles to be closed. Moreover, with the central arrangement of the flanging disc 4, a small, compact construction of the bottle closing arrangement 1 is obtained. For example, as shown in FIG. 2, a small pitch of the rotor 2 can be obtained so that small bottles coming with high speed to the bottle transporting element 39 can be closed with uniform speed in the bottle closing arrangement 1. The quiet passage of the bottles through the bottle closing arrangement 1 provides for a very low particle discharge and distribution. Moreover, no drives are located above the bottles 12. The bottles are rotated by downwardly located drives on the one hand, and guided on a circular path which is especially important for the operation with laminar flow on the other hand.

It will be understood that each of the elements described above, or two or more together, may also find a useful application in other types of constructions differing from the types described above.

While the invention has been illustrated and described as embodied in an arrangement for closing bottles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for closing bottles, comprising a rotor arranged to move bottles over a partially circular path; a flanging device provided with a flanging element arranged to engage with lower edges of caps to be placed on the bottles; bottle gripping means connected with said rotor and arranged to rotate the bottles about their own axes and also to disengage the bottles from said flanging element, said flanging element including a centrally arranged disc having a ring-shaped part with a peripheral edge engageable with the cap, said disc having an axis which extends parallel and is eccentric relative to an axis of said rotor, and said disc being arranged so that the partially circular path of the bottles extends around said peripheral edge of said disc.

2. An arrangement as defined in claim 1, wherein said gripping means include a plurality of bottle grippers connected with said rotor.

3. An arrangement as defined in claim 1, wherein said partially circular path of the bottles has a radius which is equal to the sum of a radius of said disc of said flanging element and a radius of a cap mountable of a head of the bottles.

4. An arrangement as defined in claim 1, wherein said disc of said flanging element is radially displaceable relative to said rotor.

5. An arrangement as defined in claim 1, wherein said disc of the flanging element has a thickness which decreases toward said peripheral edge.

6. An arrangement as defined in claim 1, wherein said peripheral edge of said disc of said flanging element is formed as a blunt cutting edge.

7. An arrangement as defined in claim 1, wherein said disc of said flanging element is non-rotatably held on said rotor.

8. An arrangement as defined in claim 1, wherein said disc of said flanging element is freely rotatably supported on said rotor.

9. An arrangement as defined in claim 1, wherein said disc of said flanging element is mounted exchangeably on said rotor.

10. An arrangement as defined in claim 2, wherein said bottle gripper has a cap centering element engageable with a head of the bottles and a lifting device engageable with the bottles and controlled by a curve.

11. An arrangement as defined in claim 10, wherein said cap centering element has a rotatably supported centering head; and further comprising a spring supporting said centering head.

12. An arrangement as defined in claim 10, wherein said cap centering element of said bottle gripper is vertically adjustable on said rotor.

13. An arrangement as defined in claim 10, wherein said cap centering element of said bottle gripper and said disc of said flanging element together form a flanging head which is removable from said rotor.

14. An arrangement as defined in claim 13, wherein said flanging head is vertically adjustable; and further comprising means for vertically adjusting said flanging head.

15. An arrangement as defined in claim 14, wherein said vertical adjusting means includes a handle wheel.

16. An arrangement as defined in claim 10; and further comprising a wedge belt drive, said lifting device being connected in its working position with said wedge belt drive.

17. An arrangement as defined in claim 10; and further comprising a toothed wheel drive, said lifting device being connected in its working position with said toothed wheel drive.

18. An arrangement as defined in claim 16, wherein said wedge belt drive is steplessly adjustable.

19. An arrangement as defined in claim 16, wherein said toothed wheel drive is steplessly adjustable.

* * * * *